US005901472A

United States Patent [19]

Adam

[11] Patent Number: 5,901,472

[45] Date of Patent: May 11, 1999

[54] ATHLETIC SHOE SYSTEM AND REMOVABLE CLEAT

[75] Inventor: John M. Adam, Marietta, Ga.

[73] Assignee: Diversified Industrial Technology, Inc., Marietta, Ga.

[21] Appl. No.: 08/815,139

[22] Filed: Mar. 11, 1997

Related U.S. Application Data

[63] Continuation-in-part of application No. 08/690,847, Aug. 1, 1996, abandoned.

[51] Int. Cl.[6] ..... A43D 5/00; A43C 15/00

[52] U.S. Cl. ..... 36/134; 36/67 R; 36/67 D

[58] Field of Search ..... 36/59 A, 59 C, 36/67 R, 67 A, 67 D, 134

[56] References Cited

U.S. PATENT DOCUMENTS

| | | | |
|---|---|---|---|
| D. 201,952 | 8/1965 | Johns | D7/5 |
| 1,012,057 | 12/1911 | Brady . | |
| 1,230,118 | 6/1917 | Clifford . | |
| 1,232,896 | 7/1917 | Clifford . | |
| 1,304,616 | 5/1919 | Smith . | |
| 1,550,772 | 8/1925 | Allan . | |
| 1,554,580 | 9/1925 | Kaplan | 36/59 C |
| 1,634,611 | 7/1927 | Deschamps | 36/67 R |
| 1,827,514 | 10/1931 | Golden . | |
| 1,876,195 | 9/1932 | Youmans . | |
| 2,235,774 | 3/1941 | Pierce et al. | 36/67 D |
| 2,261,785 | 11/1941 | Youmans | 36/59 |
| 2,292,239 | 8/1942 | Pierce et al. | 36/59 |
| 2,677,905 | 5/1954 | Dye | 36/59 |
| 2,803,070 | 8/1957 | Passidomo et al. | 36/59 |
| 3,271,885 | 9/1966 | McAuliffe | 36/2.5 |
| 3,302,227 | 2/1967 | Bente | 36/67 D |
| 3,512,275 | 5/1970 | Leavitt | 36/59 |
| 3,656,245 | 4/1972 | Wilson | 36/67 |
| 3,707,047 | 12/1972 | Nedwick | 36/2.5 R |
| 4,014,114 | 3/1977 | Jordan et al. | 36/57 |
| 4,205,466 | 6/1980 | Collins | 36/67 D |
| 4,299,038 | 11/1981 | Epple | 36/67 |
| 4,306,360 | 12/1981 | Hagger | 36/134 |
| 4,577,422 | 3/1986 | Tanel | 36/126 |
| 4,653,206 | 3/1987 | Tanel | 36/126 |
| 4,689,901 | 9/1987 | Ihlenburg | 36/126 |
| 4,723,366 | 2/1988 | Hagger | 36/134 |
| 4,748,752 | 6/1988 | Tanel | 36/126 |
| 5,029,405 | 7/1991 | De Haitre | 36/134 |
| 5,259,129 | 11/1993 | Deacon et al. | 36/127 |
| 5,623,774 | 4/1997 | Abbey | 36/67 D |

FOREIGN PATENT DOCUMENTS

| | | | |
|---|---|---|---|
| 407377 | 9/1909 | France | 36/67 A |
| 792190 | 9/1934 | France | 36/67 A |
| 73890 | 4/1916 | Germany | 36/67 A |
| 467815 | 12/1951 | Italy | 36/67 A |
| 15362 | 7/1899 | United Kingdom | 36/67 A |
| 209851 | 1/1924 | United Kingdom | 36/67 A |
| 2265539 | 10/1993 | United Kingdom | 36/134 |

OTHER PUBLICATIONS

"Here's the Soft Golf Spike That's Hard To Beat"—Champ Tred–Lite—Believed to be known to others prior to Aug. 1, 1996.

*Primary Examiner*—M. D. Patterson
*Attorney, Agent, or Firm*—Louis T. Isaf

[57] ABSTRACT

An athletic shoe system is provided comprising a shoe with shoe sole, non-metal screw boss, and cleat. The cleat of the preferred embodiment is usable with the shoe system of the present invention or with prior art athletic shoe systems. The preferred invention includes a removable plastic cleat having a disc-shaped body with a downwardly projecting generally circular pattern of ridges on its bottom side and an upwardly projecting threaded stem on its top side. A non-metal screw boss for embedding in the sole of a shoe has a cylindrical body with a threaded bore. An array of lobes project radially outwardly from the lower end of the cylindrical body and a corresponding set of truncated cone-shaped tabs project upwardly from the lobes. In use, a plurality of the screw bosses are embedded within the shoe sole during molding with the threaded bores of the bosses exposed through the bottom of the sole. The cleats can then be removably installed on the sole by threading their threaded stems into the threaded bores of the embedded bosses.

28 Claims, 5 Drawing Sheets

ATHLETIC SHOE SYSTEM AND REMOVABLE CLEAT

This application is a continuation-in-part of U.S. patent application Ser. No. 08/690,847, filed Aug. 1, 1996, now abandoned.

TECHNICAL FIELD

This invention relates generally to shoes and more particularly to cleats and cleat assemblies for use on the soles of athletic shoes, such as golf shoes, to improve traction and performance.

BACKGROUND OF THE INVENTION

Athletic shoes having soles with protruding cleats have long been used by athletes and "sportsters" to enhance the traction and position stabilization of the feet of the user. From early years, the athletic shoe cleats were configured as metal spikes, and eventually "soft spikes" (.e.g, made of synthetics such as hard nylons and plastic), that project downwardly from the soles of their shoes and into the soil of the field of play; and the spiked cleat was used in athletic shoes for sports as wide ranging as football, baseball, soccer and golf. Because the metal and synthetic cleats can wear down or break, the spiked cleats were eventually incorporated as part of a replaceable cleat system which included a plurality of threaded, metal screw bosses embedded into the sole of the shoe and into which the spikes, outfitted with a threaded stem, were threaded.

The traditional spiked cleats fulfilled the intended purpose of aiding in traction and position stabilization of the feet during the stationary swinging efforts of golf, as well as during encounters of opposition or in instances where enhancement of forward momentum was desirable. Eventually, with the aid of studies and research, it was determined that, while spiked cleats provide aggressive traction for sports such as football and baseball, not all sports require such radical traction. Furthermore, the value of the spiked cleat is being questioned even in the aggressive sports (such as football), where knee and other injuries are sometimes attributed to the overly aggressive "traction" of the elongated spiked cleats. Also, especially in the less aggressive sports, concern over the damage created by spiked cleats to the field of play and other surfaces is beginning to outweigh any traction benefits afforded by the spiked cleat.

One sport in which the concern for damage to surfaces has led to changing cleat designs is the sport of golf. In this sport of traditionally metal, spiked cleats, the tendency of metal spiked cleats to pit and deface surfaces such as concrete walks, wooden floors, and carpet is legendary. Spiked cleats also deface greens and fairways of golf courses, particularly in winter months.

In addition to problems associated with injuries and damage to surrounding properties, the traditional screw-in type of replaceable cleat shoe system has other problems associated with the metal screw bosses that are embedded in shoe soles for receiving cleats. One key problem is that the bosses tend to oxidize or rust over time because they are continuously exposed to moisture during wear. This makes it very difficult in some instances to remove an old cleat and replace it with a new cleat and, in extreme cases, can render the boss unusable. Another problem is that the metal screw bosses can become loose and dislodged within the latex rubber of shoe soles in which they are often embedded. When this happens, it becomes virtually impossible to remove an old cleat or install a new one because the affected screw boss simply spins inside the latex in which it is encased upon attempts to thread or unthread a cleat.

Presently, in many sports, including golf, alternatives to the spiked cleat (both metal and synthetic) are available. Such alternatives include the elimination of cleats of any kind and replacing cleated sole with soft, raised treads. Other alternatives have chosen to retain the cleat concept while eliminating the undesirable "spike"; and one example of such an alternative cleat is found in U.S. Pat. No. 5,259,129. Furthermore, it is not unknown in the art to at least provide a synthetic screw boss in athletic shoes—see, for example, U.S. Pat. No. 4,299,038.

In spite of prior art efforts, there remain challenges and problems for which improvements are useful; and the present invention is intended to address some of those challenges and problems.

SUMMARY OF THE INVENTION

Briefly described, the present invention, in one sense, comprises an improved athletic shoe system which includes a sole into which is embedded a plurality of uniquely designed, non-metallic, threaded bosses, and includes cleats removably threaded in each of the bosses. The invention, in another sense, comprises a uniquely designed, replaceable, cleat for use on an athletic shoe. In its preferred embodiment, the cleat of the present invention finds acceptable use as a cleat on a golf shoe. The cleat of the present invention is useable as the cleat on the athletic shoe system of the present invention, thus providing a preferred embodiment of the invented athletic shoe system, and, alternatively, the cleat is useable as the cleat in a traditional athletic shoe (e.g., golf shoe) having metal bosses (either a retrofit or initially specified cleat).

The cleat of the present invention comprises a unitary body molded of pliable PVC plastic. The body includes a generally disc-shaped base having a unique pattern of weight supporting lightly flexible ridges formed on and projecting from the bottom surface thereof. A threaded stem projects axially upwardly from the top surface of the base and is adapted to be threaded into a screw boss embedded within the sole of a golf shoe for attachment of the cleat to the shoe.

The ridges that project from the bottom surface of the disc-shaped base are arrayed in a pattern that is subdivided into four quadrants by two diametrically extending channels. The ridge patterns within each quadrant include at least two concentrically aligned, radially displaced, arcuate ridge segments. These radially displaced arcuate ridge segments are separated by a trough that communicates at its ends with the diametrically extending channels. In a first embodiment, the cleat of the present invention includes a third radially displaced ridge segment in each quadrant, which third ridge is separated from the adjacent ridge by an additional trough that communicates at its ends with the diametrically extending channels. A second embodiment of the cleat of the present invention includes, rather than the third radially displaced ridge, at least one radially aligned ridge segment which interconnects with and extends radially from one of the (preferably the innermost) arcuate ridge segments. This arrangement of ridges, troughs, and channels insures "air cushioned" comfort for a wearer and also allows for easy removal of debris such as dirt and sod that can sometimes become embedded in the cleat. In addition, the diametrically extending channels allow for simple in-the-field removal and replacement of the cleat with a coin or the side of a divot tool. The tips of the ridges of the cleat are appropriately blunted to minimize any tendency of the cleat to damage susceptible surfaces while simultaneously providing appropriate surface friction to insure stability and control during a golf swing.

The disc-shaped base of the cleat is molded with a cupped configuration so that the top side of the base, from which the threaded stem projects, is slightly convex before the cleat is installed. As the stem is threaded into a screw boss in a shoe sole, the advancing stem pulls the cupped base flat against the sole. In this way, the tendency of the base to spring back to its cupped shape exerts constant pressure on the shoe sole and, in turn, constant back force on the threads of the stem within the screw boss. This back force on the threads and frictional engagement between the cleat base and shoe sole effectively lock the cleat in place and prevent it to from accidentally unthreading and becoming loose as the wearer's foot twists and moves about during wear.

The unique screw boss that forms a part of the cleat assembly of this invention is molded of relatively hard, non-corrosive plastic material, preferably polyvinylchloride (PVC), and is designed to remain securely locked in place within the latex or other material of a shoe sole in which it is embedded. The screw boss comprises a cylindrical body with a central threaded bore sized and tapped to receive the threaded stem of a cleat. Four generally disc-shaped lobes project laterally outwardly from the cylindrical body at or adjacent the bottom end thereof, that is, at the end of the body that is exposed for receiving a cleat when the boss is embedded within a sole. A truncated cone-shaped stabilizing tab projects upwardly from each of the lobes toward the top end of the threaded cylindrical body.

The screw boss of this invention is embedded within the sole of a shoe during manufacture in the same manner as a prior art metal boss. In general the sole is molded around a plurality of screw bosses that are appropriately held in place within the mold. Each screw boss thus becomes embedded with the material of the sole with its threaded bore exposed through the bottom of the sole and, preferably, with its laterally projecting lobes embedded just beneath the bottom surface of the sole. The stabilizing tabs project from their respective lobes up into the material of the sole, where they, too, are securely embedded. The embedded lobes and tabs effectively lock the boss in place within the material of the sole to prevent the boss from working loose as a wearer twists and moves around during a golf game and as the wearer removes and replaces cleats as necessary. The plastic material, being more compatible with the material of the sole than metal, aids in locking the boss in place, is more accepting of the threaded plastic stem of the cleats of this invention, and is not subject to the oxidation that can render prior art metal bosses useless.

Thus, a unique synthetic, non-spiked cleat is now provided. Furthermore, a unique boss incorporated within a shoe sole, provides an improved athletic shoe system. The cleat of the invention is formed with a unique pattern of ridges, troughs, and channels that provide air cushioned comfort and superior traction both on and off the golf course. The cleat is molded as a unitary piece of PVC plastic material, for corrosion resistance, and has a threaded stem for threading the cleat into a screw boss embedded within the sole of a shoe. The cupped base of the cleat is flattened against the sole as the threaded stem is advanced into its boss to provide friction and back force that locks the cleat securely in place. The screw boss of the cleat assembly is also formed of molded plastic to resist corrosion and is configured to stay firmly and securely embedded within the material of a shoe sole and to resist becoming dislodged and loose during use of the shoe and replacement of cleats.

Other features, objects, and advantages of the present invention (as well as other challenges and problems addressed by the present invention) will become apparent upon review of the detailed description set forth below taken in conjunction with the accompanying drawings.

DETAILED DESCRIPTION OF THE PREFERRED EMBODIMENT

Figure 1:
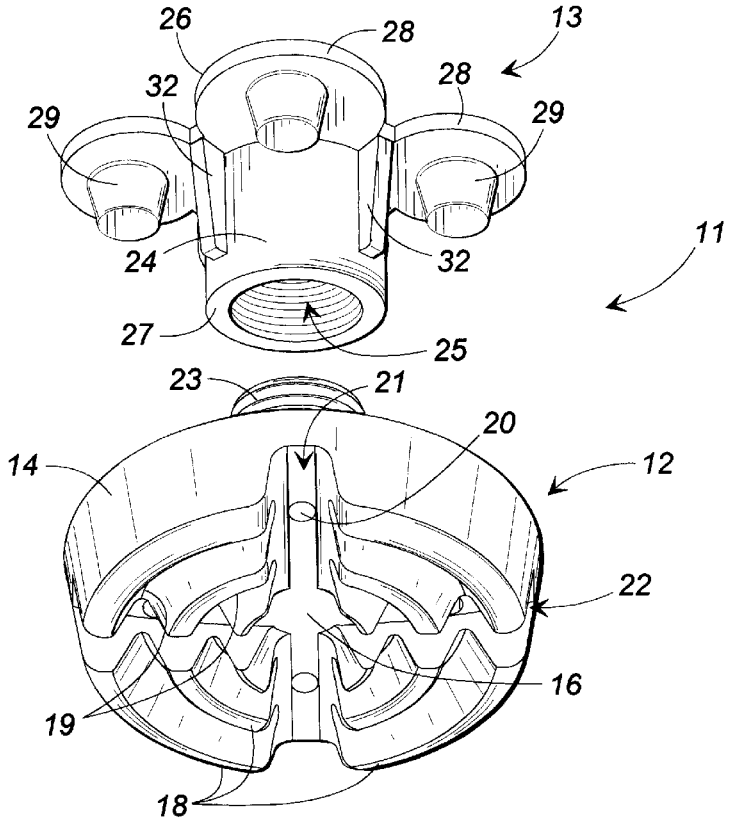
FIG. 1 is an exploded perspective view of a first embodiment of a cleat and screw boss assembly that embodies principles of the present invention in a preferred form.

Referring in more detail to the drawings, wherein like numerals reference like parts throughout the several views, FIG. 1 is a first embodiment of a cleat assembly of the invention. The assembly 11 comprises a cleat 12 and a screw boss 13 to which the cleat 12 can be mounted. The cleat 12 preferably is molded as a single unitary piece from a pliant PVC plastic or other suitable non-metallic material and the screw boss is also molded of PVC plastic.

Figure 2A:
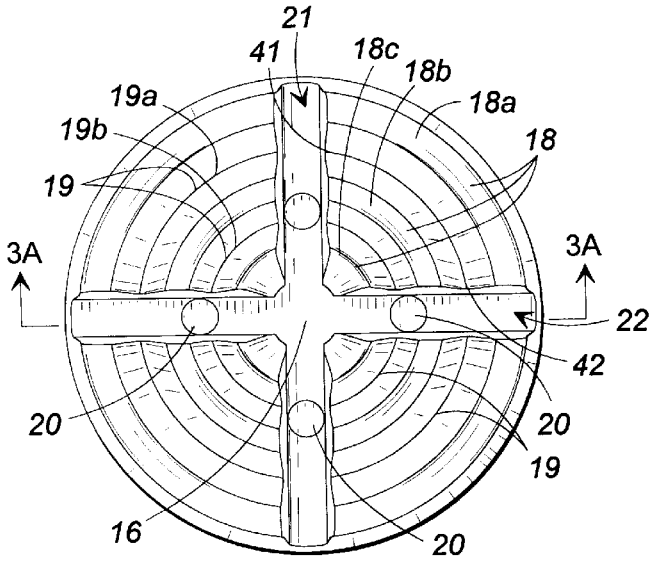
FIGS. 2A and 2B are top and side plan views respectively of the first embodiment of the cleat of the present invention.
Figure 2B:
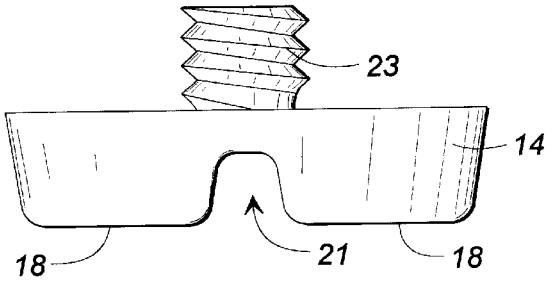
Figure 3A:
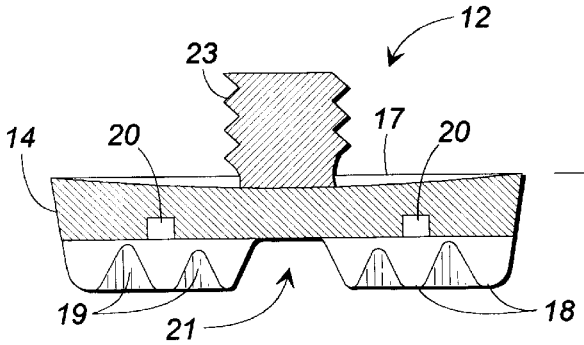
FIG. 3A is a cross-sectional view of the first embodiment of a cleat taken along line 3A—3A of FIG. 2A illustrating the cupped configuration of the cleat base.

The cleat 12 has a generally circular disc-shaped face 14 having a bottom surface 16 and a top surface 17 (FIG. 3A). A set of spaced ridges 18 project downwardly from the bottom surface 16 of the base 14 and are arranged in a generally concentric circular array. As best seen in FIG. 2A, the ridges 18 are spaced apart from one another to define generally circular troughs 19 between adjacent ridges. First and second diametrically extending mutually transversely oriented channels 21 and 22 extend across the bottom surface 16 of the cleat 12. The channels 21 and 22 subdivide the ridge array into four quadrants. Each of the quadrants contains a section of the ridge array, and the troughs between adjacent ridge sections in each quadrant communicate at their ends with the adjacent channels 21 and 22. This configuration has been found to provide a path for air and water to move quickly from the troughs between adjacent ridges, to the channels, and away from the cleat. This, in turn, provides an "air cushioned" support system which enhances the wearing comfort provided by the athletic shoe outfitted with the cleats of the present invention. In addition, the concentric ridge and trough pattern provides for simple removal of debris that may get caught in the cleats. It has also been found that the channels 21 and 22 provide a convenient means for installing or removing a cleat with a coin or the edge of a divot tool. As a further aid in this regard, dimples 20 are formed projecting into the bottom surface 16 of the cleat and the dimples are spaced to receive the prongs of divot tool for installing and removing a cleat.

In the preferred first embodiment as shown, it is seen that each quadrant contains three ridges 18*a*, 18*b*, 18*c*, each ridge extending, unbroken, from one channel 21 in an arcuate path to the other channel 23; and each of the troughs, of which there are two 19*a*, 9*b* extends, without diversion, from a first end 41 at one channel 21 to its other end 42 at the other channel 22.

A threaded stem 23 projects axially and upwardly from the top surface 17 of the base 14. The stem 23 is configured to be threaded into a standard screw boss embedded within the sole of an athletic shoe or into the unique screw boss 13 which forms a part of the present invention. In this way, cleats 12 can be selectively removed and replaced simply by unthreading an old or worn cleat and threading in a new cleat.

The unique screw boss 13 of the present invention, which is adapted to be molded into and embedded within the material of the sole of an athletic shoe, comprises a generally cylindrical body 24 having a top end 26 and a bottom end 27. A threaded bore 25 extends through the body 24 and is provided with internal threads adapted to mate with the threads of a threaded stem 23 on a cleat 12. An array of generally circular disc-shaped lobes 28 project radially outwardly from the top end 26 of the body 24 to form a fanned or winged array. A truncated cone-shaped stabilizing tab 29 projects downwardly from each of the lobes 28 toward the bottom end 27 of the body 24. As detailed below, the lobes 28 and their associated stabilizing tabs 29 become firmly embedded and encased within the material of a shoe sole when the screw boss 13 is molded into the sole. With such configuration, the screw boss 13 of the present invention, when molded into the material of a shoe sole, is held firmly and securely in place within the sole and resists any tendency to become loose and dislodged as can be the case with prior art metal screw bosses. The plastic material from which the boss is molded is also more compatible with the material of the sole than is metal, which helps to hold the boss firmly in place.

Figure 3B:
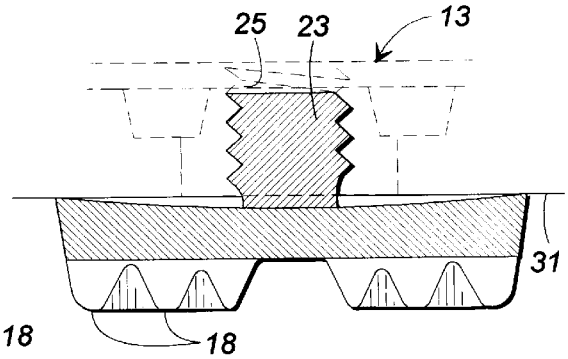
FIG. 3B is also a cross-sectional view of the first embodiment of a cleat illustrating how the base of the cleat is drawn flat against the sole of a shoe when the cleat is installed.

FIGS. 3A and 3B illustrate the unique cupped configuration of the cleat base 14 for locking the cleat into place on the sole of a shoe. Specifically, the base 14 of the cleat 12 is molded to have a generally cupped configuration defining a convex shape of the top surface 17 of the base. The threaded stem 19 is seen to extend upwardly from the center of the top surface 17. The cleat 12 is molded of a PVC plastic or other suitable material that is formulated to be sufficiently pliant so that the cup shape of the base 14 can be flattened relatively easily. When the cleat 12 is in its uninstalled cupped configuration as shown in FIG. 3A, the lower tips of the ridges 18 lie substantially in a plane perpendicular to the axis of the base 14.

FIG. 3B illustrates the flattening of the cupped shaped base against the sole 31 of a shoe when the cleat is installed on the bottom of the sole. A screw boss 13 is shown in phantom lines embedded within the material of the sole. As the threaded stem 19 is advanced into the threaded bore 25 to mount the cleat to the sole, the force provided by the advancing stem pulls the cup-shaped base 14 against the sole 31 of the shoe. This action assists in preventing the unintended loosening of the cleat. Since the material of the cleat is pliant, the tendency of the base 14 to spring back to its cupped shape provides back force between the threads of the stem and the bore. This back force acts like a lock washer that holds the threads securely in their mated relationship with each other.

In addition, the tendency of the base 14 to spring, back to its cupped configuration also keeps the base in constant frictional engagement with the sole of the shoe. This frictional engagement complements the back force on the threads so that the cleat becomes firmly locked in place when installed on the shoe sole and resists becoming loose or unscrewed as a wearer twists, moves about, and walks on the cleats.

As illustrated in FIG. 3B, when the cleat is drawn flat against the shoe sole 31, the innermost ridges of the ridge pattern are drawn upwardly so that their tips are now above the tips of outbound ridges. This configuration provides increasing support and traction as the more outbound ridges are compressed and the inbound ridges engage a surface on which a wearer is standing. The second and third cleat embodiments have an identical cupped configuration of the cleat base.

Figure 4:
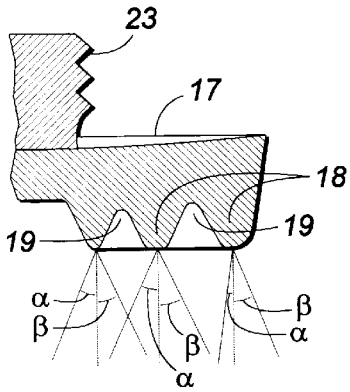
FIG. 4 is a partial cross-sectional view of the first embodiment of the cleat illustrating the configuration of the ribs thereof

FIG. 4 illustrates a preferred configuration of the ridges 18 of the first preferred embodiment. The ridges 18 are seen to have tapered sides and generally rounded-over or blunted tips. Preferably, the sides of the ridges 18 are tapered such that the angle $\alpha$ as illustrated in FIG. 4 is about 10° and the angle $\beta$ is about 20°. Second and third embodiments of the cleat have preferably identical tapered sides. However, other amounts of taper as well as no taper at all are possible and are within the scope of the present invention. The blunted bottom tips of the ridges 18 ensures that the cleats of this invention are "surface friendly" with little tendency to damage ground, carpet, tile, concrete, wooden floors, greens, and turf. At the same time, the ridge pattern in conjunction with the pliable material, from which the cleat is molded, provides desirable traction, particularly when the cleats of the present invention are used by a golfer.

Figure 5:
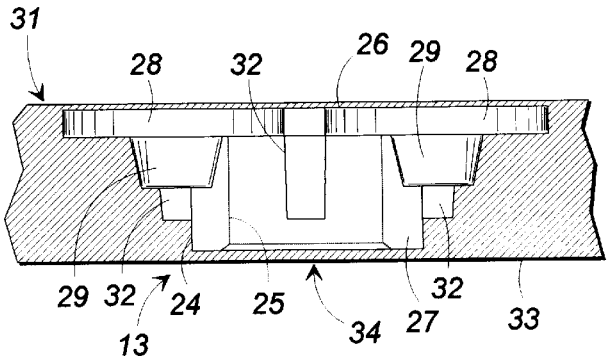
FIG. 5 is a side, cross-sectional, cutaway view of a portion of a shoe sole of an athletic shoe system in accordance with one embodiment of the present invention, illustrating, in plan view, a preferred embodiment of the screw boss of the present invention.
Figure 6:
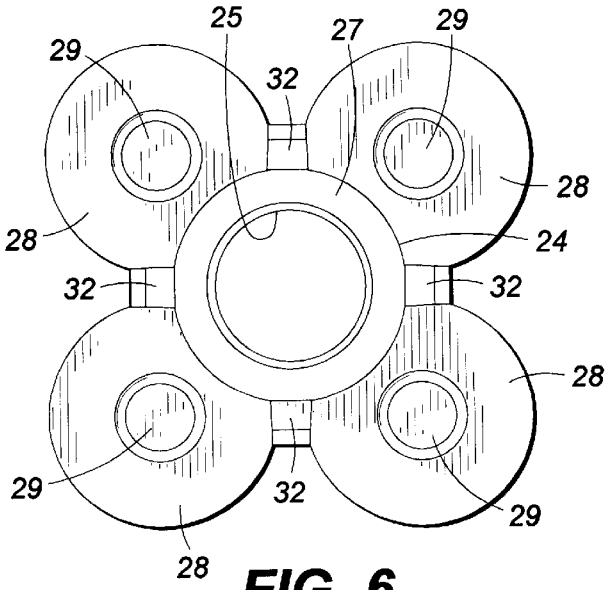
FIG. 6 is a top plan view of the screw boss of FIG. 5.

FIGS. 5 and 6 illustrate a preferred embodiment of the screw boss 13 that forms a part of the present invention—FIG. 5 illustrating the boss embedded in the sole 31 of a shoe, as part of the athletic shoe system of the present invention. The boss 13 is seen to be formed with a generally cylindrical body 24 having a central threaded bore 25. The body 24 has a top end 26 and a bottom end 27 (FIG. 1). A set of four generally disc-shaped lobes 28 project radially outwardly from the bottom end 27 of the body 24 in a clover leaf pattern. Support ribs 32 are formed between the body 24 and the projecting lobe array to support the lobes and the body relative to each other. Each of the lobes 28 is provided with an upwardly extending truncated cone-shaped stabilizing tab 29 that extends upwardly toward the position of the top end 26 of the body 24.

In use, the screw boss 13 is molded into and becomes embedded and encased within the material of a shoe sole 31 when the sole is manufactured (see FIG. 5). When so embedded, the lobes 28 are positioned at or just below the bottom surface 32 of the sole and the tabs 29, ribs 32 and body 24 extend upwardly into the sole material. The threaded bore 25 of the screw boss 13 is exposed through an opening 34 in the sole so that the threaded stems 19, 119 and 219 of cleats 12, 112 and 212, respectively, can be threaded into the threaded bores to install the cleats on the bottom of the shoe.

The configuration of the screw boss 13 in conjunction with the fact that it is formed from a PVC plastic or other non-metal material provides several unique advantages. First, the plastic material of the screw boss is more compatible than is metal with the latex plastic material of most athletic shoe soles. This, in conjunction with the unique configuration of the lobes and tabs, holds the screw boss firmly and securely in place within the material of the shoe sole to prevent the boss from becoming loose or dislodged within the sole. In addition, the plastic screw boss is not subject to oxidation or corrosion, which is a primary problem with prior art metal bosses.

Figure 7:
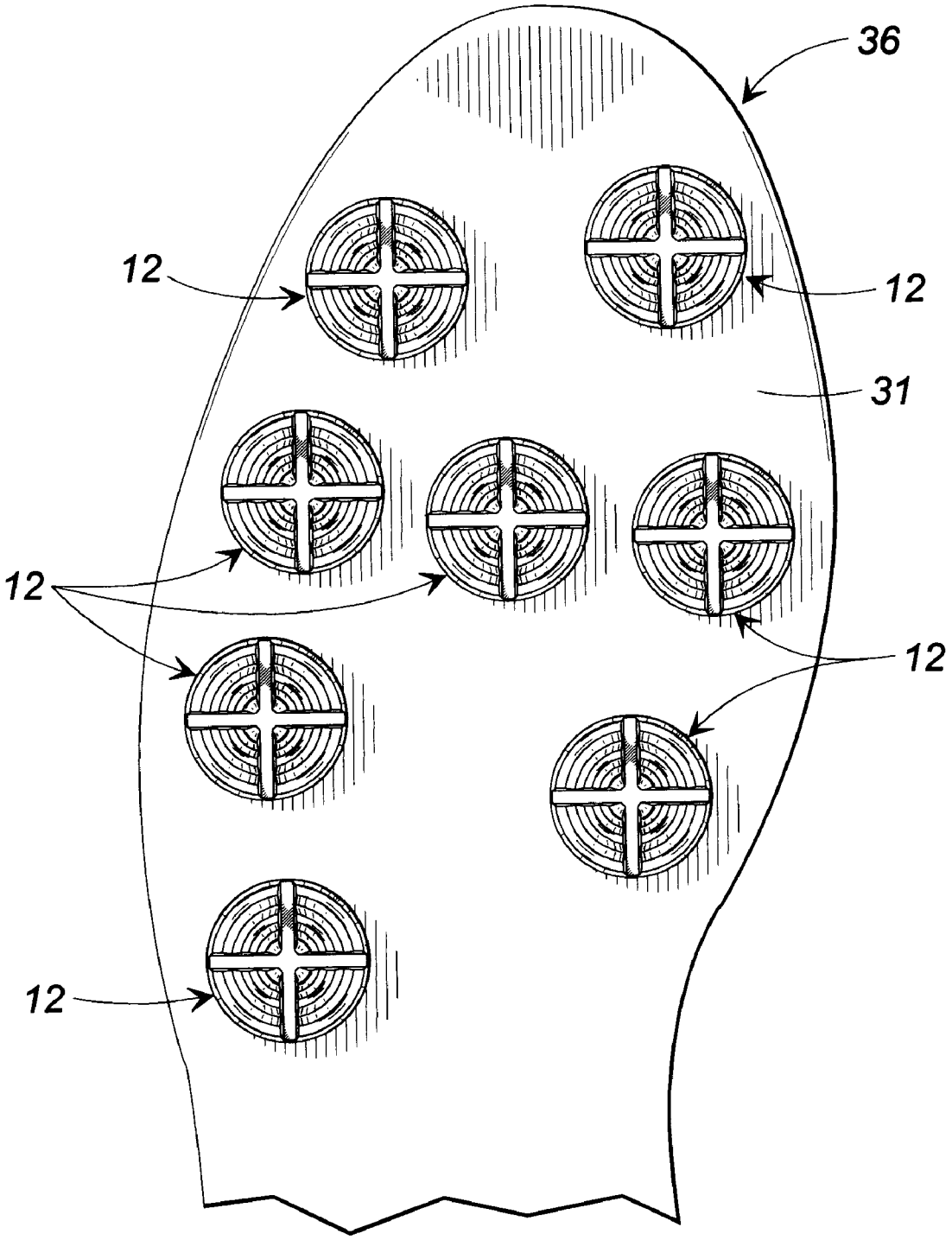
FIG. 7 illustrates a portion of a shoe sole, representing an athletic shoe system in accordance with one embodiment of the present invention, having an array of cleats of this invention mounted thereto.
Figure 8:
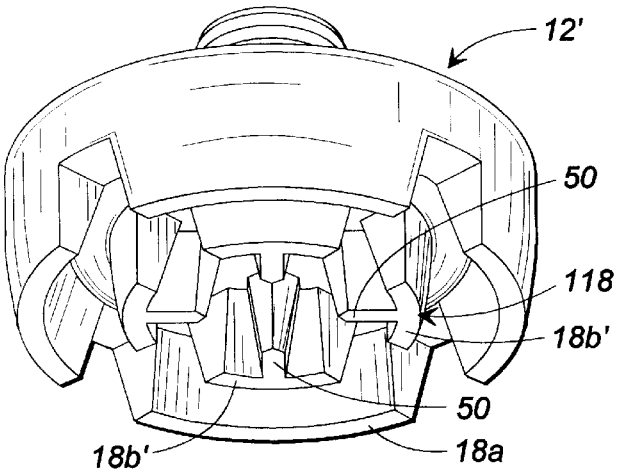
FIG. 8 is a perspective view of a second embodiment of the cleat.
Figure 9:
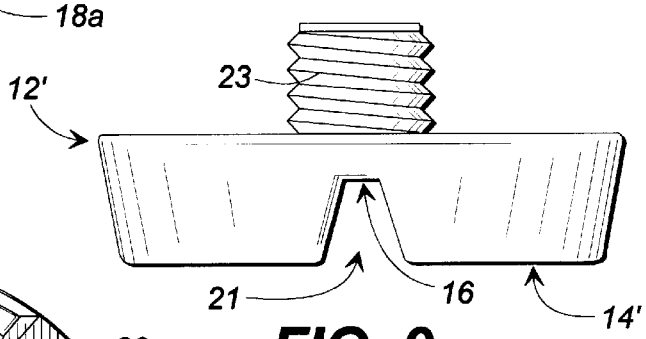
FIG. 9 is a side plan view of the second embodiment of the cleat.
Figure 10:
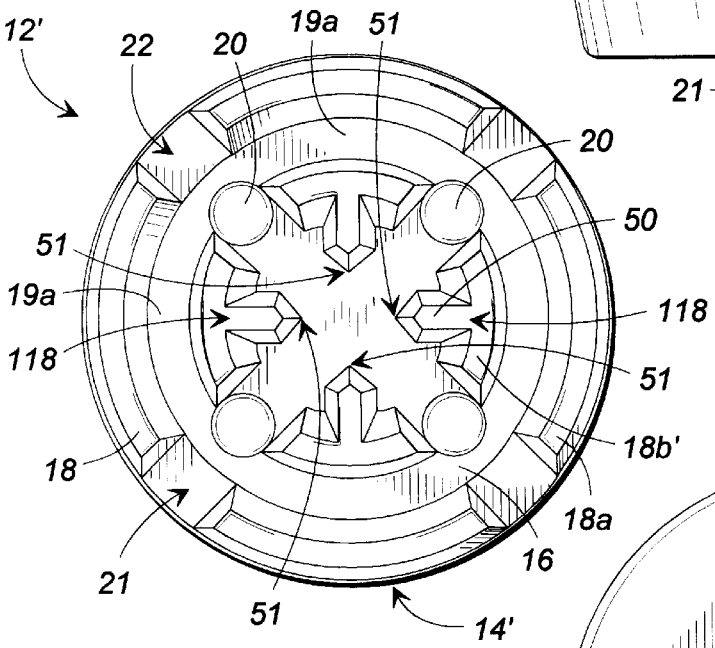
FIG. 10 is a top plan view of the second embodiment of the cleat.
Figure 11:
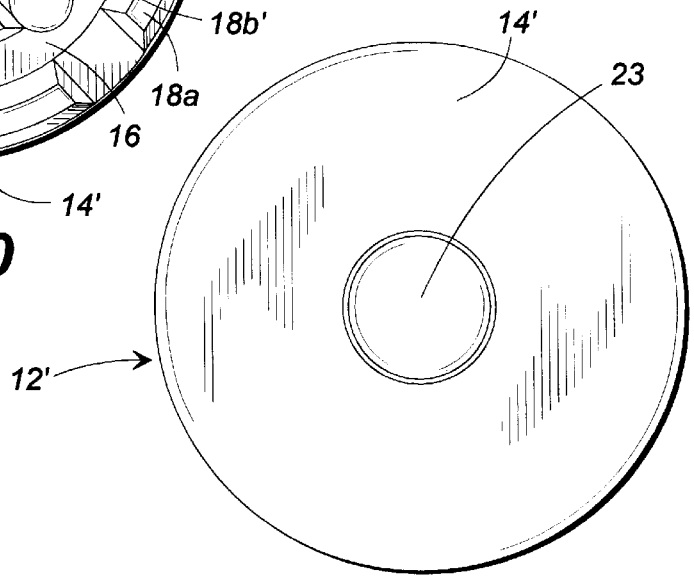
FIG. 11 is a bottom plan view of the second embodiment of the cleat.
Figure 12:
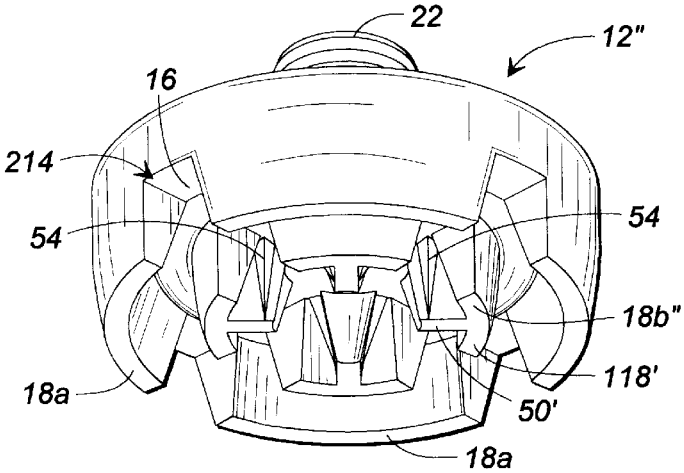
FIG. 12 is a perspective view of a third embodiment of the cleat.
Figure 13:
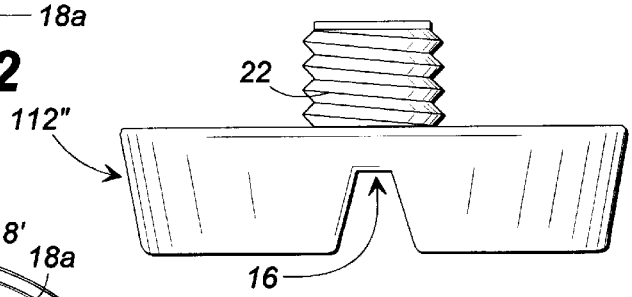
FIG. 13 is a side plan view of the third embodiment of the cleat.
Figure 14:
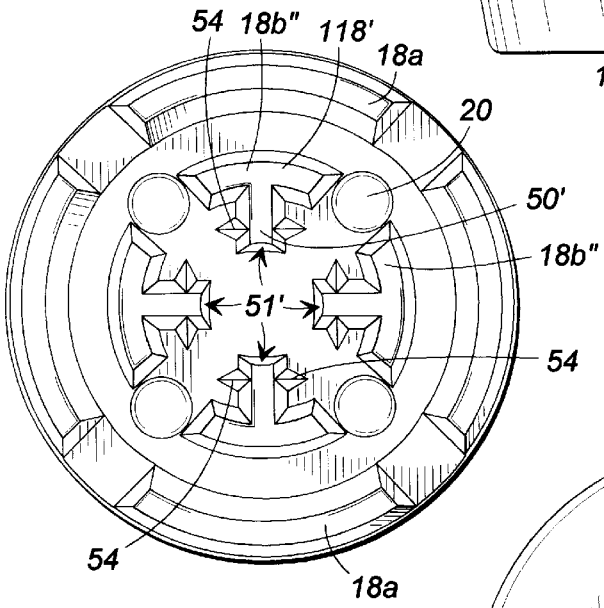
FIG. 14 is a top plan view of the third embodiment of the cleat.
Figure 15:
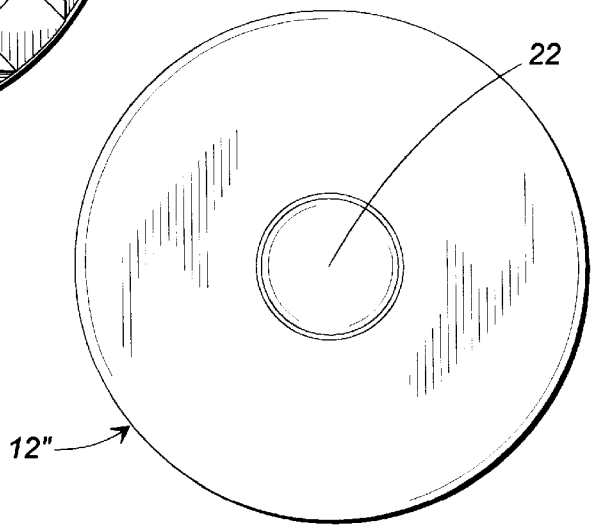
FIG. 15 is a bottom plan view of the third embodiment of the cleat.

FIG. 7 shows a part of the sole 31 of an athletic golf shoe 36 having the unique cleats of the present invention installed thereon. While only a portion of the shoe 36 is illustrated in FIG. 7, it will be understood that the pattern of cleats can and generally do cover most of the bottom surface of the sole including the heel. The shoe upper section (not shown) is readily understood. The cleats are seen to be arrayed in a predetermined pattern on the sole 37. Numerous patterns are possible and the pattern illustrated in FIG. 7 is meant only as an illustration.

FIGS. 8–11 illustrate a second preferred embodiment of a cleat 12' in accordance with the present invention. This cleat 12' has a generally circular disc-shaped base 14' having a bottom surface 16. A plurality of spaced ridges 18*a*, 118 extend downwardly from the bottom surface 16 of the base 14'. Outer ridges 18 extend around the perimeter of the bottom surface 16 of the base 14' and are arranged in a generally circular configuration. T-shaped ridges 118 are located inside the perimeter of the outer ridges 18. The T-shaped ridges 118 include a hat portion 18*b*' and a leg portion 50. The hat portions 18*b*' are arranged in a generally concentric circular configuration inside the circular configuration of the outside ridges 18. The leg portions 50 extend from the center of the hat portion 18*b*' toward the center of surface 16 terminating at a radially innermost edge 51, in this case to a pointed end. Outside ridges 18 and T-shaped ridges 118 are spaced apart from one another to define a generally circular trough 19*a* between adjacent ridges. First and second diametrically extending mutually transversely oriented channels 21 and 22 extend across the bottom surface 16 of the cleat 12'. The channels 21 and 22 subdivide ridge pairs 18*a* and 118 into four quadrants. Each of the quadrants contains a section of the pair of ridges, and a section of the trough 19*a* between adjacent outer ridge 18 a section and hat portion 18*b*' section in each quadrant communicates at its ends with adjacent channels 21 and 22. This cleat configuration of the second embodiment provides similar advantages to those of the cleat configuration described in the first embodiment. The addition of the leg portion 50 to ridge 118 (186*b*') adds support to ridge 118 which in turn adds overall support to the cleat 12'. As in the first embodiment, dimples 20 are formed projecting into the bottom surface 16 of the cleat and the dimples are spaced to receive the prongs of a divot tool for installing and removing a cleat.

FIGS. 12–15 illustrate a third preferred embodiment of a cleat 12" in accordance with the present invention. This cleat 12" is very similar to the cleat 12' of the second embodiment in that it has an outer ridge 18*a* extending downwardly from the bottom surface 16 of the base 14" and to around its perimeter, and T-shaped ridges 118' extending from the bottom surface 16 inside the perimeter of the outer ridges 18*a*. The major difference between the second embodiment and the third embodiment of the cleat is the inclusion of a pair of wedges 54 extending from opposite sides of the base of the leg portion 50' of each T-shaped ridge 118'. These wedges 54 add additional support to the leg portion 50' of the T-shaped ridge 118' and therefore additional support to the overall cleat. Furthermore, the leg portion 50' terminates into a convex shaped inner edge 51'. This third embodiment provides similar advantages to those of the cleat configurations described in the first and second embodiments. As in the first and second embodiment, dimples 20 are formed in the bottom surface 16 of the cleat and the dimples are spaced to receive the prongs of a divot tool for installing and removing a cleat. Just as the first embodiment of the cleat includes a threaded stem 23 projecting axially and upwardly from the top surface 17 of the base 14, the second and third embodiments have a threaded stem 22.

Except as described in the foregoing paragraphs with respect to the second and third embodiments (or as may be apparent from the drawings), the cleats 12', 12" of FIGS. 8–15 are similar in structure to that of FIGS. 1–7 and they interact with the screw boss 13 and shoe sole 31 in a similar fashion.

The invention has been described herein in terms of three preferred embodiments. It will be understood by those of skill in this art, however, that various other embodiments, and modifications and departures from the illustrated embodiments might well be made within the scope of the invention. For example, the cleat of this invention might be formed within only a single diametrically extending channel rather than the two channels illustrated in the three preferred embodiments. In such a case, the concentric ring-shaped ridges would be divided into two sections, rather than into quadrants. Alternatively, the cleat may be formed with no channels at all. Further, the particular configuration of the screw boss of the present invention with its radially projecting lobes and stabilizing tabs is preferred. However, other specific configurations might well be contemplated by those of skill in the art with comparable results. The preferred material from which the cleat and screw boss of the present invention are molded is a PVC plastic material. Other materials might also be used, such as, for example, a latex material, or a non-PVC plastic. Although it is preferred that the cleat and screw boss be molded entirely of non-metallic material, metallic elements or portions might be employed with the present invention is desired for particular uses and purposes. Finally, the preferred embodiments of the invention have been presented in terms of a golf shoe and cleat. Clearly, other types of athletic shoes are also contemplated. These and other additions, deletions, modifications might well be made to the embodiments illustrated herein without departing from the spirit and scope of the invention as set forth in the claims.

I claim:

1. A cleat assembly for removably securing a cleat to the sole of an athletic shoe, which sole has a generally planar lower surface, said cleat assembly comprising:

a non-metal screw boss adapted to be embedded in the sole of the shoe, said screw boss comprising a body having a threaded bore, said screw boss being adapted to be embedded within the sole of the shoe above the planar lower surface of the sole, and said threaded bore being exposed through the sole;

a cleat having a generally disc-shaped base with a bottom side and a top side, said disc-shaped base including a pair of diametrically extending channels formed in said bottom side of said disc-shaped base;

a generally concentric circular array of ridges projecting from said bottom side of said base, adjacent ridges being spaced apart to define generally circular trough therebetween, at least one of said ridges including an integral leg portion having at least one integral wedge, said channels being oriented at substantially right angles relative to each other to subdivide said concentric array of ridges into quadrants of substantially semicircular ridges; and a threaded stem projecting axially from said top side of said base, said threaded stem being adapted to be threaded into said threaded bore of said screw boss to releasably attach said cleat to the sole of a shoe in which said screw boss is embedded.

2. A cleat assembly as claimed in claim 1 and wherein at least some of said ridges are blunted.

3. A cleat assembly as claimed in claim 1 and wherein said disc-shaped base of said cleat is cupped to define a convex shape of said top side of said base.

4. A cleat assembly as claimed in claim 3 and wherein said cleat is molded from an elastic material so that said cupped base is flattened against the sole of a shoe as said threaded stem is advanced into said screw boss embedded within the sole to provide friction and back force for locking said cleat in place.

5. A cleat assembly as claimed in claim 1 and wherein said boss includes an array of lobes radiating outwardly from said body.

6. A cleat assembly as claimed in claim 5 and wherein at least some of said lobes are provided with a tab projecting outwardly therefrom, each of said tabs being frustoconical in shape.

7. A cleat assembly as claimed in claim 1, wherein said cleat is made of a non-metal material.

8. A removable cleat for attachment to the sole of an athletic shoe having screw bosses with threaded bores exposed through the bottom of the sole, said cleat comprising a generally disc-shaped base having a bottom side and a top side, a set of ridges projecting from said bottom side of said base and being arranged in a generally concentric circular array, adjacent ridges being spaced apart to define a trough therebetween, and a threaded stem projecting from said top side of said base, said stem being sized and configured to be threaded into a selected screw boss of the athletic shoe to releasably attach said cleat to the sole of the shoe; and wherein said base is formed with two diametrically extending intersecting channels extending across its bottom side, said channels dividing said array of ridges into four quadrants of generally arcuate ridges with the troughs in each quadrant communicating with said channels, each said ridge extending, unbroken, from one said channel in an arcuate path to the other said channel, at least one of said ridges including an integral leg portion having at least one integral wedge, and each of said troughs extending, without diversion, from a first end at one said channel to its other end at the other said channel.

9. The removable cleat as claimed in claim 8, and wherein said cleat is made of non-metal material.

10. A removable cleat for attachment to the sole of an athletic shoe having screw bosses with threaded bores exposed through the bottom of the sole, said cleat comprising a generally disc-shaped base having a bottom side and a top side, a set of ridges projecting from said bottom side of said base and being arranged in a generally concentric circular array, said ridges being spaced apart to define troughs therebetween, at least one of said ridges including an integral leg portion having at least one integral wedge, and a threaded stem projecting from said top side of said base, said stem being sized and configured to be threaded into a selected screw boss of the athletic shoe to releasably attach said cleat to the sole of the shoe; and wherein said base is cupped to define a generally convex shape of said top side of said base.

11. A removable cleat as claimed in claim 10, and wherein said cleat base is formed of an elastic material to be drawn flat against the sole of a shoe as said threaded stem is advanced into a screw boss embedded in the shoe sole to provide friction and back force to hold the cleat securely in place.

12. A removable cleat as claimed in claim 11, wherein said cleat is made of non-metal material.

13. An athletic shoe system, including a shoe having an upper portion and a sole, said sole of said shoe having a set of non-metal screw bosses embedded therein with each screw boss having a threaded bore exposed through said sole, and a set of non-metal cleats having threaded stems secured within said threaded bores to mount said cleats removably to said sole, each of said cleats having an exposed bottom surface with a plurality of spaced ridges projecting downwardly therefrom, adjacent ridges being formed in a generally concentric circular array with a circular trough defined between adjacent ridges, and at least one of said ridges including an integral leg portion having at least one integral wedge.

14. An athletic shoe as claimed in claim 13, and further comprising at least one channel formed in and extending across said bottom surface of each of said cleats, said channel dividing said array of ridges into sections of generally semi-circular ridges.

15. An athletic shoe as claimed in claim 14, and wherein the lower surface of each of said cleats is formed with two intersecting channels extending diametrically thereacross, said channels dividing said array of ridges into quadrants of generally semicircular ridges, said troughs in each of said quadrants communicating with said channels.

16. A cleat assembly for removably securing a cleat to the sole of an athletic shoe, which sole has a generally planar lower surface, said cleat assembly comprising:

a non-metal screw boss adapted to be embedded in the sole of the shoe, said screw boss comprising a body having a threaded bore, and said threaded bore being exposed through the sole, a cleat having a generally disc-shaped base with a bottom side and a top side, a generally concentric circular array of ridges projecting from said bottom side of said base, adjacent ridges being spaced apart to define generally circular troughs therebetween, wherein at least one of said ridges includes an integral leg portion;

a pair of diametrically extending channels formed in said bottom side of said disc-shaped base, said channels being oriented at substantially right angles relative to each other to subdivide said concentric array of ridges into quadrants of substantially arcuate ridges; and a threaded stem projecting axially from said top side of said base, said threaded stem being adapted to be threaded into said threaded bore of said screw boss to releasably attach said cleat to the sole of a shoe in which said screw boss is embedded.

17. A cleat assembly as claimed in claim 6 and wherein said integral leg portion includes at least one integral wedge.

18. A removable cleat for attachment to the sole of an athletic shoe having screw bosses with threaded bores exposed through the bottom of the sole, said cleat comprisinga a generally disc-shaped base having a bottom side and a top side, said disc-shaped base of said cleat being cupped to define a convex shape of said top side of said base;

a set of ridges projecting from said bottom side of said base and being arranged in a generally concentric circular array, adjacent ridges being spaced apart to define a trough therebetween, wherein at least one of said ridges includes an integral leg portion; and a threaded stem projecting from said top side of said base, said stem being sized and configured to be threaded into a selected screw boss of the athletic shoe to releasably attach said cleat to the sole of the shoe;

wherein said base is formed with two diametrically extending intersecting channels extending across its bottom side, said channels dividing said array of ridges into four quadrants of generally arcuate ridges with the troughs in each quadrant communicating with said channels, each said ridge extending, unbroken, from one said channel in an arcuate path to the other said channel, and each said trough extending, without diversion, from a first end at one said channel to its other end at the other said channel.

19. A removable cleat as claimed in claim 18, and wherein said integral leg portion includes at least one integral wedge.

20. The cleat of claim 18, wherein said cleat is made entirely of non-metal material.

21. A removable cleat for attachment to the sole of an athletic shoe having screw bosses with threaded bores exposed through the bottom of the sole, said cleat comprising:

a generally disc-shaped base having a bottom side and a top side;

a set of ridges projecting from said bottom side of said base and being arranged in a generally concentric circular array, said ridges being spaced apart to define troughs therebetween, wherein at least one of said ridges includes an integral leg portion including at least one integral wedge; and a threaded stem projecting from said top side of said base, said stem being sized and configured to be threaded into a selected screw boss of the athletic shoe to releasably attach said cleat to the sole of the shoe;

wherein said base is cupped to define a generally convex shape of said top side of said base.

22. A removable cleat as claimed in claim 21, and wherein said cleat base is formed of a material that is sufficiently pliant to be drawn flat against the sole of a shoe as said threaded stem is advanced into a screw boss embedded in the shoe sole to provide friction and back force to hold the cleat securely in place.

23. A removable cleat as claimed in claim 21, wherein said cleat is made entirely of non-metal material.

24. An athletic shoe system, comprising:

a shoe including a shoe upper section for receiving a foot therein and a sole defining an upper surface to which said shoe upper section is attached and a generally planar lower surface;

a plurality of non-metal screw bosses adapted to be embedded in said sole of said shoe, each said screw boss of said plurality of screw bosses comprising a body having a threaded bore, each said screw boss being fully embedded within said sole of said shoe above the planar lower surface and below the upper surface of the sole, and said threaded bore of each said boss being exposed through the sole;

a plurality of cleats, each cleat of said plurality of cleats being releasably threaded within said bore of said boss, each said cleat including an upper sole engaging surface abutting said lower surface of said sole and each said cleat of said plurality of cleats comprising a generally disc-shaped base having a bottom side and a top side, a set of ridges projecting from said bottom side of said base and being arranged in a generally concentric circular array, adjacent ridges being spaced apart to define a trough therebetween, and said base formed with two diametrically extending intersecting channels extending across its bottom side, said channels dividing said array of ridges into four quadrants of generally arcuate ridges with the troughs in each quadrant communicating with said channels, each said ridge extending, unbroken, from one said channel in an arcuate path to the other said channel, at least one of said ridges including an integral leg portion, and each said trough extending, without diversion, from a first end at one said channel to its other end at the other said channel, and a threaded stem projecting from said top side of said base, said stem being sized and configured to be threaded into a selected said screw boss to releasably attach said cleat to said sole of said shoe.

25. The athletic shoe system of claim 24, wherein said integral leg portion includes at least one integral wedge.

26. An athletic shoe system, including a shoe having an upper portion and a sole, said sole of sad shoe having a set of non-metal screw bosses embedded therein with each screw boss having a threaded bore exposed through said sole, and a set of non-metal cleats having threaded stems secured within said threaded bores to mount said cleats removably to said sole, each of said cleats having an exposed bottom surface with a plurality of spaced ridges projecting downwardly therefrom, adjacent ridges being formed in a generally concentric circular array with a circular trough defined between adjacent ridges, at least one of said ridges including an integral leg portion, said bottom surface of each of said cleats being formed with two intersecting channels extending diametrically thereacross, said channels dividing said array of ridges into quadrants of generally semicircular ridges, said troughs in each of said quadrants communicating with said channels.

27. An athletic shoe as claimed in claim 26, wherein said integral leg portion includes at least one integral wedge.

28. A removable cleat for attachment to the sole of an athletic shoe, said cleat comprising:

a generally disc-shaped base having a bottom side and a top side;

an array of ridges formed on and projecting from said bottom side, at least one of said ridges including an integral leg portion, and said leg portion including at least one integral wedge;

a stem projecting axially upwardly from said tope side of said base, said stem being adapted to be attached within the sole of an athletic shoe.

* * * * *